US011647813B1

(12) United States Patent
Rao

(10) Patent No.: US 11,647,813 B1
(45) Date of Patent: May 16, 2023

(54) QUICK LACING SYSTEM

(71) Applicant: Chunming Rao, Dong Guan (CN)

(72) Inventor: Chunming Rao, Dong Guan (CN)

( * ) Notice: Subject to any disclaimer, the term of this patent is extended or adjusted under 35 U.S.C. 154(b) by 0 days.

(21) Appl. No.: 17/804,884

(22) Filed: Jun. 1, 2022

(51) Int. Cl.
*A43C 11/16* (2006.01)

(52) U.S. Cl.
CPC ..... *A43C 11/165* (2013.01)

(58) Field of Classification Search
CPC ..... A44C 11/165; A44C 11/20; A44C 11/00; A44C 11/16; A44C 7/00; Y10T 24/2183; Y10T 24/37
See application file for complete search history.

(56) References Cited

U.S. PATENT DOCUMENTS 8,231,074 B2 * 7/2012 Hu ..... A43C 11/20 242/388.2
9,072,341 B2 * 7/2015 Jungkind ..... A43C 11/165
10,945,492 B2 * 3/2021 Kim ..... A43C 7/08
2007/0084956 A1 * 4/2007 Chen ..... A43C 7/00 242/388.6
2010/0308605 A1 * 12/2010 Fiedler ..... E05B 47/004 292/251.5
2012/0228419 A1 * 9/2012 Chen ..... A43C 11/165 242/395
2015/0076272 A1 * 3/2015 Trudel ..... A43C 7/00 242/381.4
2017/0295888 A1 * 10/2017 Chen ..... A43C 11/165
2017/0325548 A1 * 11/2017 Ha ..... A43C 11/165
2018/0257276 A1 * 9/2018 Hipwood ..... A61F 5/01
2019/0008236 A1 * 1/2019 Ha ..... A43C 11/165
2019/0174869 A1 * 6/2019 Wang ..... B65H 75/26
2019/0174872 A1 * 6/2019 Kawano ..... B65H 75/38
2019/0320763 A1 * 10/2019 Jiang ..... B65H 75/4431
2020/0128918 A1 * 4/2020 Chen ..... A43C 7/08
2020/0268108 A1 * 8/2020 Fiedler ..... A45C 13/1069
2020/0346888 A1 * 11/2020 Kruse ..... A43B 23/0205
2021/0127794 A1 * 5/2021 Chen ..... A43C 11/165
2021/0127795 A1 * 5/2021 Chen ..... A43C 11/08
2021/0401121 A1 * 12/2021 Kim ..... A41F 1/00

* cited by examiner

*Primary Examiner* — Robert Sandy
*Assistant Examiner* — Rowland Do

(57) ABSTRACT

A quick lacing machine is disclosed, including a base, a screw cap, a pulley, a rotating wheel, a rotary driving member, an elastic member, and a pressing member. The base is provided with a rotating cavity, a lace hole and a ratchet; the pulley is rotatably arranged in the rotating cavity, and the pulley is provided with a plurality of a first spiral teeth; the rotating wheel is provided with a pawl, the pawl is engaged with the ratchet, and the rotating wheel is provided with a sliding hole, the rotary driving member is slidably arranged in the sliding hole. The present disclosure can loosen a shoelace by pressing the pressing member, and tighten the shoelace by rotating the screw cap, which is simple and convenient to operate, saves time and effort, and thereby improving efficiency of a user taking off and putting on shoes.

10 Claims, 4 Drawing Sheets

QUICK LACING SYSTEM

TECHNICAL FIELD

The present application relates to the technical field of shoes, in particular to a quick lacing machine.

BACKGROUND

Shoelaces play a role of restraining and fixing shoes and feet. Tying shoelaces is a tedious process, every time a user puts on or takes off your shoes, there will be a set of such processes. Especially when the user is busy, tying shoelaces may be said to be an annoying thing. In addition, the fastened shoelaces are also easy to loosen, which brings unsafe factors. When not paying attention, it is easy to be stepped on by others or hooked by some fixed objects and cause dangerous. Moreover, traditional shoelaces are easily soiled, which affects beauty of the shoes. For a lacing process of shoelaces, many different devices may also be used to replace. For example, a lacing device etc., but existing lacing devices have complex structures, is still cumbersome to operate, and also have poor stability of loosening and tightening the shoelaces. Therefore, the defects are very obvious, and there is an urgent need to provide a new solution.

SUMMARY

In order to solve above-mentioned technical problems, an object of the present disclosure is to provide a quick lacing machine.

In order to achieve the object, the present disclosure uses following technical solutions.

Specifically, the present disclosure provides a quick lacing machine, including a base, a screw cap, a pulley, a rotating wheel, a rotary driving member, an elastic member, and a pressing member. The screw cap is rotatably installed on the base, the rotating wheel is clamped in the screw cap. The base is provided with a rotating cavity, a lace hole opened from a side wall of the rotating cavity, and a ratchet disposed at an opening of the rotating cavity. The pulley is rotatably arranged in the rotating cavity, and in an inner cavity of the pulley is provided with a plurality of first spiral teeth. The rotating wheel is located above the pulley, a circumferential direction of the rotating wheel is provided with a pawl, the pawl is engaged with the ratchet, a sliding hole is opened in a middle of the rotating wheel, and the rotary driving member is slidably arranged in the sliding hole. A plurality of rotary driving teeth are arranged in a circumferential direction of the rotary driving member, and the pressing member is slidably connected with the screw cap. The elastic member is accommodated in an inner cavity of the pulley, and the rotary driving member is elastically connected to the base via the elastic member. The pressing member is provided with a plurality of second spiral teeth, and the plurality of the rotary driving teeth, the first spiral teeth, and the second spiral teeth are arranged in one-to-one correspondence. A bottom bevel of the rotary driving teeth is configured to abut with the first spiral teeth, and a top bevel of the rotary driving teeth is configured to abut with the second spiral teeth.

Further, the pulley is provided with a winding roll, and the winding roll is provided with a threading hole.

Further, the pressing member includes a pressing portion and a lifting portion connected with the pressing portion. And the plurality of the second spiral teeth are arranged at a bottom of the lifting portion, the pressing portion is exposed on a top surface of the screw cap.

Further, the bottom of the lifting portion is concavely provided with a cavity, the rotary driving member is provided with a shaft, and the cavity is slidably sleeved outside of the shaft.

Further, sliding blocks are arranged in a circumferential direction of the lifting portion, and sliding grooves are recessed in an inner side wall of the sliding hole to be slidably connected with the sliding blocks.

Further, the top surface of the screw cap is provided with a pressing cavity and a via hole concavely formed from a bottom wall of the pressing cavity, the pressing portion is raised and lowered in the pressing cavity, and the lifting portion is connected with the pressing portion through the via hole.

Further, a bottom of the screw cap is concavely provided with an accommodated cavity, the via hole is communicated with the accommodated cavity, and the rotating wheel is contained in the accommodated cavity.

Further, the accommodated cavity is provided with a plurality of claws, and the plurality of the claws is all engaged with the rotating wheel.

Further, the pressing portion is detachably connected to the lifting portion.

Further, an outer side wall of the base is provided with an annular rotating groove, the screw cap is provided with an adapter block, and the adapter block protrudes into the annular rotating groove.

The present disclosure has at least following advantages. In a practical application, a shoelace is wound on the pulley, and the shoelace is passed through the lace hole. When the shoelace needs to be loosened, a downward pressing force is applied to the pressing member, so that the pressing member moves down relative to the screw cap. The plurality of the second spiral teeth of the pressing member downwardly-moving are abutted in a one-to-one correspondence with the top bevel of the plurality of rotary driving teeth of the rotary driving member. With the downward movement of the pressing member, the pressing member will resist the rotary driving member moving down along the sliding hole. The plurality of rotary driving teeth of the rotary driving member downwardly-moving are abutted in a one-to-one correspondence with the bottom bevel of plurality of the first spiral teeth of the pulley. As the pressing member and the rotary driving member are pressed down, the elastic member is compressed, then the elastic member is in a state of storing elastic potential energy. And under a cooperation of the second spiral teeth, rotary driving teeth and the first spiral teeth, the rotary driving member will drive the pulley to rotate in a reverse direction. the belt rotating in the reverse direction will release the shoelace wound thereon, so that the shoelace may be loosened and a user may take off the shoes. When the downward pressing force on the pressing member is released, the pressing member and the rotary driving member will be reset under a resilience of the elastic member, so as to facilitate the next loosening shoelace action. When the shoelace need to be tightened, the screw cap is turned in a forward direction. The rotary driving member that forwardly rotating abuts on the side wall of the first spiral teeth through the side wall of the rotary driving teeth, such that pulley rotates in the forward direction synchronously with the rotary driving member. The rotary driving member that rotates in the forward direction abuts on the side wall of the first spiral teeth through the side wall of the rotary driving teeth, so that pulley rotates in the forward direction synchronously with the rotary driving member.

The pulley that forwardly rotating wraps the shoelaces to realize tightening the shoelace, so that the user can wear the shoelace securely. Since the pawl on the rotating wheel is engaged with the ratchet on the base, the rotating wheel can only rotate in the forward direction, which can avoid an unintentional loosening the shoelace due to the reverse rotation of the rotating wheel, and thereby improving the stability of tightening the shoelace. The structure design of the present disclosure is reasonable and ingenious, the shoelace can be loosened by pressing the pressing member, and the shoelace can be tightened by rotating the screw cap, which is simple and convenient to operate, saves time and effort, and thereby improving efficiency of the user taking off and putting on the shoes.

Figure 1:
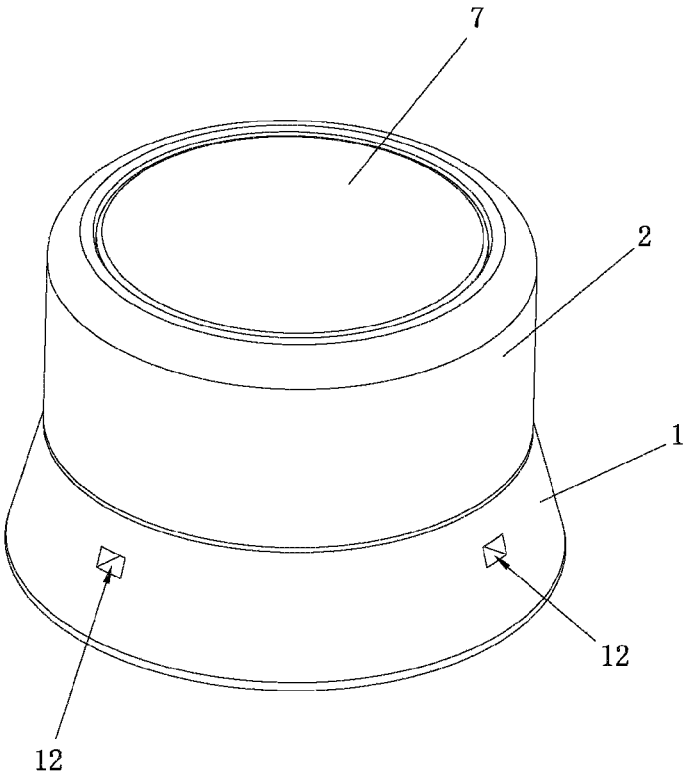
FIG. 1 is a three-dimensional structure schematic view of the quick lacing machine of the present disclosure.

Description of reference numerals are as follows.

1 base, 11 rotary cavity, 12 lace hole, 13 ratchet, 14 annular rotating groove, 15 locking hole.

2 screw cap, 21 pressing cavity, 22 via hole, 23 accommodated cavity, 24 claws, 25 adapter block.

3 pulley, 31 first spiral teeth, 32 winding roll, 33 threading hole.

4 rotating wheel, 41 pawl, 42 sliding hole, 43 sliding groove.

5 rotary driving member, 51 rotary driving teeth, 52 shaft.

6 elastic member.

7 pressing member, 71 second spiral teeth, 72 bottom bevel, 73 top bevel, 74 pressing member, 75 lifting portion, 76 cavity, 77 sliding block, 78 convex column, 79 concave hole.

DETAILED DESCRIPTION

In order to facilitate understanding of those skilled in the art, the present disclosure will be further described below with reference to the embodiments and accompanying drawings, and the content mentioned in the embodiments does not limit the present disclosure.

Figure 2:
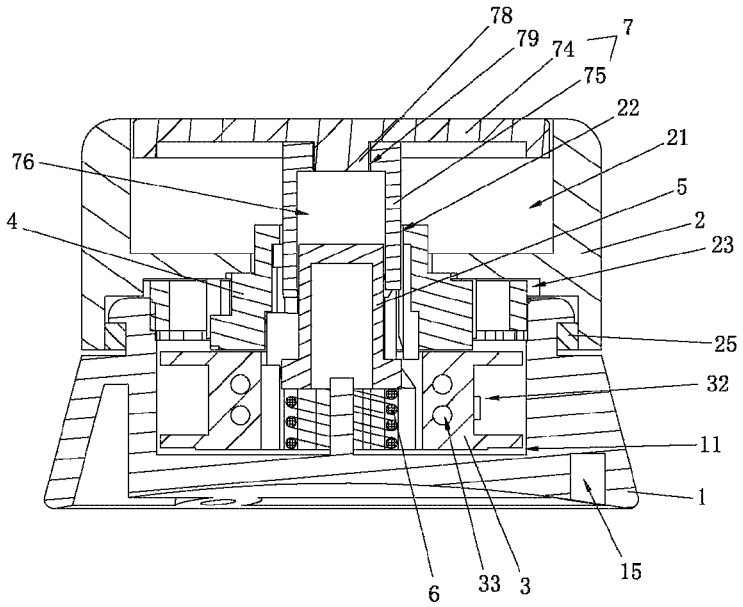
FIG. 2 is a sectional view of the quick lacing machine of the present disclosure.
Figure 3:
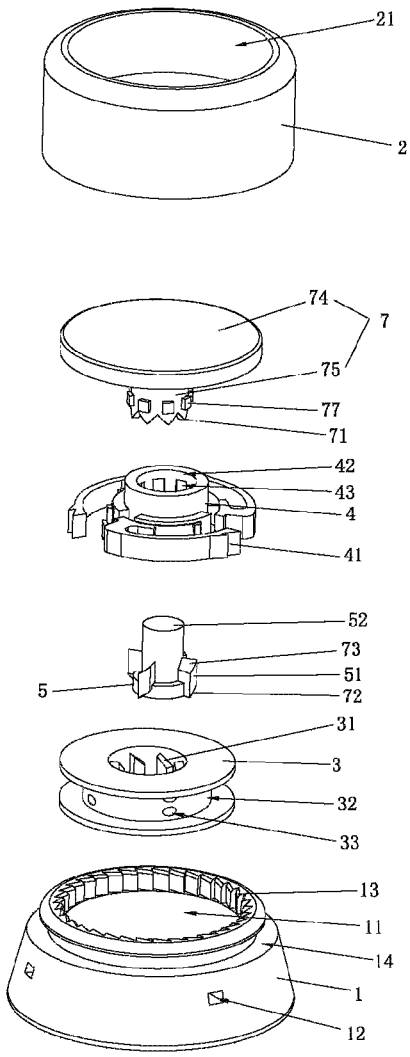
FIG. 3 is an exploded structure schematic view of the quick lacing machine of the present disclosure.
Figure 4:
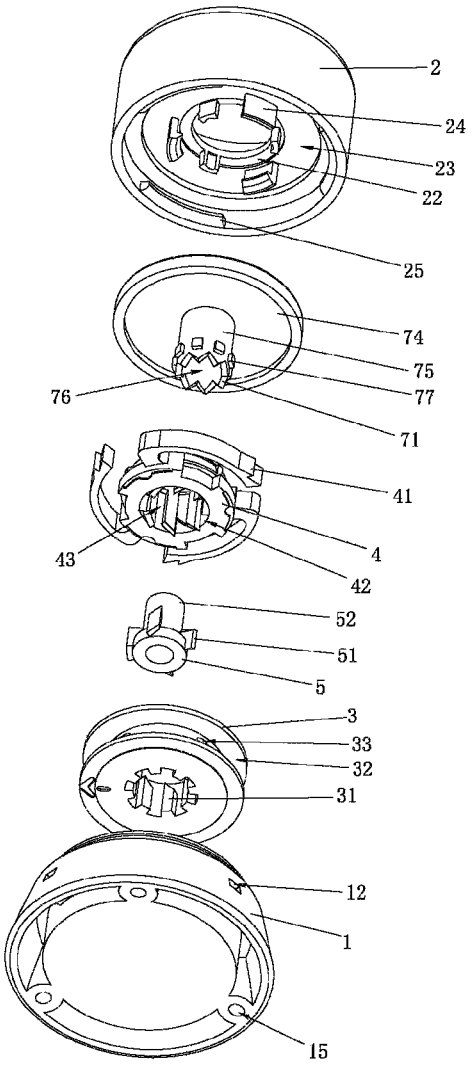
FIG. 4 is another angle exploded structure schematic view of the quick lacing machine of the present disclosure.

Referring to FIG. 1 to FIG. 4, the present disclosure provides a quick lacing machine, including a base 1, a screw cap 2, a pulley 3, a rotating wheel 4, a rotary driving member 5, an elastic member 6 and a pressing member 7. The screw cap 2 is rotatably installed on the base 1, the rotating wheel 4 is clamped in the screw cap 2. The base 1 is provided with a rotating cavity 11, a lace hole 12 opened from a side wall of the rotating cavity 11, and a ratchet 13 disposed at an opening of the rotating cavity 11. The pulley 3 is rotatably arranged in the rotating cavity 11, and a plurality of first spiral teeth 31 is arranged on an inner cavity of the pulley 3. The rotating wheel 4 is located above the pulley 3, a pawl 41 is arranged along a circumferential direction of the rotating wheel 4, and the pawl 41 is engaged with the ratchet 13. A sliding hole 42 is opened in a middle of the rotating wheel 4, and the rotary driving member 5 is slidably arranged in the sliding hole 42. A plurality of rotary driving teeth 51 are arranged along a circumferential direction of the rotary driving member 5, and the pressing member 7 is slidably connected with the screw cap 2. The elastic member 6 is accommodated in an inner cavity of the pulley 3, and the rotary driving member 5 is elastically connected to the base 1 via the elastic member 6. A top end of the elastic member 6 is abutted with a bottom end of the rotary driving member 5, and a bottom end of the elastic member 6 is abutted with a bottom wall of the rotary cavity 11. The pressing member 7 is provided with a plurality of second spiral teeth 71, and the plurality of the rotary driving teeth 51, the first spiral teeth 31, and the second spiral teeth 71 are arranged in one-to-one correspondence. A bottom bevel 72 of the rotary driving teeth 51 is configured to abut with the first spiral teeth 31, and a top bevel 73 of the rotary driving teeth 51 is configured to abut with the second spiral teeth 71. Specifically, lace holes 12 are arranged in the rotary cavity 11 in an annular array. The plurality of second spiral teeth 71 are arranged in the annular array around a central axis of the pressing member 7; the plurality of first spiral teeth 31 are arranged in the annular array around a central axis of the pulley 3; the plurality of rotary driving teeth 51 are arranged in the annular array around a central axis of the rotary driving member 5. A number of the lace hole 12 is two, free ends of the two shoelaces on the pulley 3 are respectively passed through two lace holes 12. A number of the pawl 41 is three, and three pawls 41 are evenly distributed.

In a practical application, a shoelace is wound on the pulley 3, and the shoelace is passed through the lace hole 12. When the shoelace needs to be loosened, a downward pressing force is applied to the pressing member 7, so that the pressing member 7 moves down relative to the screw cap 2. The plurality of the second spiral teeth 71 of the pressing member 7 downwardly-moving are abutted in a one-to-one correspondence with the top bevel 73 of the plurality of rotary driving teeth 51 of the rotary driving member 5. With the downward movement of the pressing member 7, the pressing member 7 will resist the rotary driving member 5 moving down along the sliding hole 42. The plurality of rotary driving teeth 51 of the rotary driving member 5 downwardly-moving are abutted in a one-to-one correspondence with the bottom bevel 72 of plurality of the first spiral teeth 31 of the pulley 3. As the pressing member 7 and the rotary driving member 5 are pressed down, the elastic member 6 is compressed, then the elastic member is 6 in a state of storing elastic potential energy. And under a cooperation of the second spiral teeth 71, rotary driving teeth 51 and the first spiral teeth 31, the rotary driving member 5 will drive the pulley 3 to rotate in a reverse direction. The belt rotating 3 in the reverse direction will loosen the shoelace wound thereon, so that the shoelace may be loosened and a user may take off the shoes. When the downward pressing force on the pressing member 7 is released, the pressing member 7 and the rotary driving member 5 will be reset under a resilience of the elastic member 6, so as to facilitate the next loosening shoelace action. When the shoelace need to be tightened, the screw cap 2 is turned in a forward direction. The screw cap 2 that forwardly rotating drives the rotating wheel 4 to rotate forwardly, and the rotating wheel 4 that forwardly rotating drives the rotary driving member 5 to rotate synchronously. The rotary driving member 5 that forwardly rotating abuts on the side wall of the first spiral teeth 31 through the side wall of the rotary driving teeth 51, such that the pulley 3 rotates in the forward direction synchronously with the rotary driving member 5. The pulley that forwardly rotating wraps the shoelace to realize tightening the shoelace, so that the shoelace are tightened and the user can wear the shoe securely. Since the pawl 4 on the rotating wheel 4 is engaged with the ratchet 13 on the base 1, the rotating wheel 4 can only rotate in the forward direction, which can avoid an unintentional loosening the shoelace due to the reverse rotation of the rotating wheel 4, and thereby improving the stability of tightening the shoelace. The structure design of the present disclosure is reasonable and ingenious, the shoelace can be loosened by pressing the pressing member 7, and the shoelace can be tightened by rotating the screw cap 2, which is simple and convenient to operate, the stability of the tightening and loosening the shoelace is excellent, and thereby saving time and effort, and also improving efficiency of the user taking off and putting on the shoes.

In an embodiment, the pulley 3 is provided with a winding roll 32, and the winding roll 32 is provided with a threading hole 33. The shoelace is wound in the winding roll 32 after passing through a plurality of the threading hole 33, and the shoelace wound in the winding roll 32 is passed out of the base 1 through the lace hole 12.

In an embodiment, the pressing member 7 includes a pressing portion 74 and a lifting portion 75 connected with the pressing portion 74, the plurality of the second spiral teeth 71 are arranged at a bottom of the lifting portion 75, the lifting portion 75 is connected to the sliding hole 42, and the pressing portion 74 is exposed on a top surface of the screw cap 2. In a practical application, the pressing portion 74 is pressed downwards, so that the pressing member 7 may move down, which facilitates the pressing member 7 to contact the rotary driving member 5 to move downward through the second spiral teeth 71.

In an embodiment, a cavity 76 is recessed at the bottom of the lifting portion 75, a shaft 52 is provided on the rotary driving member 52, and the cavity 76 is slidably sleeved outside of the shaft 52. By such designs, which not only facilitates lifting and lowering of the pressing member 7, but also facilitates the pressing member 7 to drive the rotary driving member 5 to move down synchronously, and a movement stability is good.

In an embodiment, sliding blocks 77 are arranged in a circumferential direction of the lifting portion 75, and sliding grooves 43 are recessed in an inner side wall of the sliding hole 42 to be slidably connected with the sliding blocks 77. When the pressing member 7 is lifted and lowered, the sliding blocks 77 moves up and down along the sliding grooves 43, which can improve the stability of the lifting and lowering of the pressing member 7. During an upward movement and reset of the pressing member 7, when the sliding blocks 77 abuts with the sliding grooves 43, the sliding blocks 77 may be limited, which can ensure the stability of the upward movement and reset of the pressing member 7 and prove the pressing member 7 reset complete.

Specifically, the number of the sliding blocks 77 and the sliding grooves are multiple, the plurality of the sliding blocks 77, the sliding grooves 43 and the rotary driving teeth 51 are provided in a one-to-one correspondence, and the rotary driving teeth 51 is slidingly connected with the sliding grooves 43. By such designs, on the one hand, the lifting and lowering stability of the pressing member 7 and the rotary driving member 5 can be improved, thereby improving the stability of the reverse rotation of the pulley 3, and further improving the stability of loosening the shoelace; on the other hand, the stability of the forward rotation of the pulley 3 driven by the rotary driving member 5 can be improved, thereby improving the stability of tightening the shoelace.

In an embodiment, the top surface of the screw cap 2 is provided with a pressing cavity 21 and a via hole 22 concavely formed from a bottom wall of the pressing cavity 21, the pressing portion 74 is disposed in the pressing cavity 21 for up and down, and the lifting portion 75 is connected with the pressing portion 74 through the via hole 22. By such designs, the pressing member 7 and the screw cap 2 are compact in structure and beautiful in appearance, which is favorable for pressing the pressing member 7.

In an embodiment, a bottom of the screw cap 2 is concavely provided with an accommodated cavity 23, the via hole 22 is communicated with accommodated cavity 23, and the rotating wheel 4 is contained in the accommodated cavity 23. Such design can make the structure of the screw cap 2 and the rotating wheel 4 compact and reduce a volume of the lacing machine of the present disclosure.

In an embodiment, the accommodated cavity 23 is provided with a plurality of claws 24, the plurality of claws 24 are all engage with the rotating wheel 4. The rotating wheel 4 is clamped in the accommodated cavity 23 of the screw cap 2 through a cooperation of the plurality of claws 24, so that a connection between the rotating wheel 4 and the screw cap 2 is firm, and a working stability is excellent.

In an embodiment, the pressing portion 74 is detachably connected to the lifting portion 75, thereby realizing a modularization of the pressing member 7, which not only facilitates production and manufacture of the pressing member 7, but also facilitates disassembly and maintenance of the screw cap 2 and the pressing member 7.

Specifically, a bottom surface of the pressing portion 74 is provided with a convex column 78, a top of the lifting portion 75 is provided with a concave hole 79, and the convex column 78 is inserted into the concave hole 79. Through convex column 78 and the concave hole 79 being concave-convex cooperation, assembly of the pressing portion 74 and the lifting portion 75 can be realized, and the disassembly and assembly are convenient.

Specifically, the elastic member 6 is a spring, which has a simple structure, good elasticity, low cost, long service life and good working stability.

In an embodiment, an outside wall of the base 1 is provided with an annular rotating groove 14, and the screw cap 2 is provided with a plurality of adapter blocks 25. The plurality of adapter blocks 25 are arranged in an annular array around a central axis of the screw cap 2, and the adapter blocks 25 protrude into the annular rotating groove 14. The adapter blocks 25 are in contact with an inner wall of the annular rotating groove 14 to realize clamping the screw cap 2 and the base 1. And the adapter blocks 25 may rotate in the annular rotating groove 14, so that the screw cap 2 may rotate relative to the base 1 stably. In this way, on the one hand, it can realize a connection between the base 1 and the screw cap 2, on the other hand, it also can improve a rotation stability of the screw cap 2 relative to the base 1.

Specifically, the bottom surface of the base 1 is provided with a plurality of the locking holes 15, through a cooperation of the locking fastener and the locking holes 15, the lacing machine of the present disclosure is locked on a specific position of the shoe.

The above-described embodiments is preferred implementation schemes of the present disclosure, in addition, the present disclosure may also be realized in other ways, and any obvious replacements are all within a protection scope of the present disclosure without departing from the concept of the technical solution.

What is claimed is:

1. A quick lacing machine, comprising:

a base, a screw cap, a pulley, a rotating wheel, a rotary driving member, an elastic member, and a pressing member; wherein the screw cap is rotatably installed on the base, the rotating wheel is clamped in the screw cap;

the base is provided with a rotating cavity, a lace hole opened from a side wall of the rotating cavity, and a ratchet disposed at an opening of the rotating cavity;

the pulley is rotatably arranged in the rotating cavity, and in an inner cavity of the pulley is provided with a plurality of first spiral teeth;

the rotating wheel is located above the pulley, a circumferential direction of the rotating wheel is provided with a pawl, the pawl is engaged with the ratchet, a sliding hole is opened in a middle of the rotating wheel, and the rotary driving member is slidably arranged in the sliding hole;

a plurality of rotary driving teeth are arranged in a circumferential direction of the rotary driving member, and the pressing member is slidably connected with the screw cap;

the elastic member is accommodated in an inner cavity of the pulley, and the rotary driving member is elastically connected to the base via the elastic member;

the pressing member is provided with a plurality of second spiral teeth, and the plurality of the rotary driving teeth, the first spiral teeth, and the second spiral teeth are arranged in one-to-one correspondence;

a bottom bevel of the rotary driving teeth is configured to abut with the first spiral teeth, and a top bevel of the rotary driving teeth is configured to abut with the second spiral teeth.

2. The quick lacing machine according to claim 1, wherein the pulley is provided with a winding roll, and the winding roll is provided with a threading hole.

3. The quick lacing machine according to claim 1, wherein the pressing member comprises a pressing portion and a lifting portion connected with the pressing portion, the plurality of the second spiral teeth are arranged at a bottom of the lifting portion, and the pressing portion is exposed on a top surface of the screw cap.

4. The quick lacing machine according to claim 3, wherein the bottom of the lifting portion is concavely provided with a cavity, the rotary driving member is provided with a shaft, and the cavity is slidably sleeved outside of the shaft.

5. The quick lacing machine according to claim 4, wherein the top surface of the screw cap is provided with a pressing cavity and a via hole concavely formed from a bottom wall of the pressing cavity, the pressing portion is disposed in the pressing cavity for lift, and the lifting portion is connected with the pressing portion through the via hole.

6. The quick lacing machine according to claim 5, wherein a bottom of the screw cap is concavely provided with an accommodated cavity, the via hole is communicated with accommodated cavity, and the rotating wheel is contained in the accommodated cavity.

7. The quick lacing machine according to claim 6, wherein the accommodated cavity is provided with a plurality of claws, and the plurality of the claws are all engaged with the rotating wheel.

8. The quick lacing machine according to claim 3, wherein sliding blocks are arranged in a circumferential direction of the lifting portion, and sliding grooves are recessed in an inner side wall of the sliding hole to be slidably connected with the sliding blocks.

9. The quick lacing machine according to claim 3, wherein the pressing portion is detachably connected to the lifting portion.

10. The quick lacing machine according to claim 1, wherein an outer side wall of the base is provided with an annular rotating groove, the screw cap is provided with an adapter block, and the adapter block protrudes into the annular rotating groove.

* * * * *